US005575495A

United States Patent [19]

Dusser et al.

[11] Patent Number: 5,575,495

[45] Date of Patent: Nov. 19, 1996

[54] CROSS-COUNTRY SKI

[75] Inventors: Bruno Dusser, Seyssins; Dominique Locatelli, Autrans, both of France

[73] Assignee: Skis Rossignol SA, France

[21] Appl. No.: 290,734

[22] PCT Filed: Dec. 14, 1993

[86] PCT No.: PCT/FR93/01240

§ 371 Date: Oct. 18, 1994

§ 102(e) Date: Oct. 18, 1994

[87] PCT Pub. No.: WO94/16783

PCT Pub. Date: Apr. 8, 1994

[30] Foreign Application Priority Data

Jan. 19, 1993 [FR] France ..... 93 00679

[51] Int. Cl.[6] ..... A63C 5/00

[52] U.S. Cl. ..... 280/602

[58] Field of Search ..... 280/602, 609, 280/610, 601

[56] References Cited

FOREIGN PATENT DOCUMENTS 0235059 9/1987 European Pat. Off. .

0439713 8/1991 European Pat. Off. .

2626484 8/1989 France .

3337975 5/1984 Germany .

*Primary Examiner*—Richard M. Camby

*Attorney, Agent, or Firm*—Parkhurst, Wendel & Burr, L.L.P.

[57] ABSTRACT

This cross-country ski is more particularly intended for the technique termed "skating".

Its bearing length $L_P$, corresponding to the developed length of the sole separating the two respective front (5) and rear (6) contact lines of the ski is at most equal to 1,430 mm.

The variation in the deflexion C at the support face under a load of 40 kilograms exerted at the midpoint of said bearing length $L_P$, when the ski is placed on two supports (7,8) which are separated from each other by a length L defined as being equal to the ratio of the bearing length $L_P$ to a constant coefficient equal to 2.78, the supports (7,8) being centerd with respect to the mid-point of the bearing length. The deflection is at most equal to two millimeters, this variation in the deflexion being defined with respect to the deflexion of the ski in the absence of load, itself measured with respect to the plane P passing through the two support points (7,8).

6 Claims, 1 Drawing Sheet

1
2
3
4
5
6
7
8
9
10
11
12
13
C
P
Lp
FMP
ε
P'
PI

CROSS-COUNTRY SKI

The invention relates to a cross-country ski, and more specifically to a cross-country ski intended to be used according to the technique termed "skating".

Essentially two techniques are currently known for the practice of cross-country skiing, each linked with the technique of forward movement.

The first, classical, technique, known by the term "alternating steps", consists of thrusting each ski alternately forward in two parallel tracks made for this purpose on the run. The ski used for the practice of this technique has a central part which is arched, in particular at the support face, including a region called a "wax chamber" made at the support face. This region is intended to receive wax which has properties of adhesion to snow. As a result of the thrust exerted by the skier, the chamber comes into contact with the snow and causes the necessary holding to advance the ski. In view of the fact that the skis are guided in parallel lines made in the snow and in view of the large range of movement of the ski inherent with the actual alternate-step technique, the skis are provided with a relatively high tip which is intended to prevent any risk of the ski sticking into the snow.

There are also types of skis in which the wax chamber is replaced with sole scales, which have asperities pointing backward that prevent backward movement of the ski.

The second technique, which has emerged recently and is more sports-oriented, is called "skating". According to this technique, the skier moves by pointing his skis outward with respect to the direction of forward movement, the propulsion being provided by the alternate exertion of transverse thrusts by the skier on one of his skis. This technique is essentially broken down into four successive phases, respectively a first phase in which the ski is pressing on the outside, followed by a flat gliding phase, followed in turn by a phase of thrusting on the inner face, and finally by a so-called "flight" phase, during which the ski leaves the snow until the pressure of the following movement.

In such a ski, the wax chamber or any other system capable of providing adhesion, even point adhesion, is no longer necessary since the push is no longer exerted in the longitudinal direction but rather by means of successive and alternate transverse pressure.

In fact, skating skis require high characteristics of strength in lateral flexion and in torsion, in view of the stresses to which they are subjected. Moreover, with a ski which is too flexible, there is a risk that it will slip as a result of the pressure generated by the skier. The other fundamental element for such a ski concerns its balance with respect to the foot of the skier, in order not to hamper the flight phase which immediately follows the thrust.

Although skating skis currently available have a satisfactory performance level, they nevertheless have certain drawbacks, They may have a certain lack of maneuverability, especially during the flight phase. Furthermore, they may have relative bulkiness, caused by the principle of divergent foward movement, which may lead to crossing tips in narrow runs, or with respect to obstacles, rocks, trees, etc. lying along the run. Further still, some skis may be difficult to bring back during the flight phase since they generate wind resistance which is less and less negligible as the ski becomes longer, which, in turn detrimentally affect the "efficiency" and effectiveness of this technique. Finally, the so-called skating technique is relatively difficult to learn.

The object of the invention is to provide a cross-country ski for use according to the skating technique which overcomes all these drawbacks.

In order to achieve these results, the invention provides a cross-country ski which is both less bulky and has the appropriate technical characteristics.

SUMMARY OF THE INVENTION

The cross-country ski according to the invention, particularly intended for the technique termed "skating", is characterized in that its bearing length, corresponding to the developed length of the sole separating the two respective front and rear contact lines of the ski is at most equal to 1,430 mm, and in that the variation in the deflexion at the support face under a load of 40 kilograms exerted at the mid-point of said bearing length, when the ski is placed on two supports which are separated from each other by a length L defined as being equal to the ratio of the bearing length to a constant coefficient equal to 2.78, said supports being centred with respect to the mid-point of the bearing length, is at most equal to two millimeters, this variation in the deflexion being defined with respect to the deflexion of the ski in the absence of load, itself measured with respect to the plane passing through the two support points.

In other words, the invention comprises a ski of reduced length and higher rigidity, especially of the support face, thus guaranteeing, further to greater maneuverability and smaller bulk, effectiveness, in particular during the thrust phases, which can enhance the conversion of the energy corresponding to the thrust of the skier into actual forward movement of the ski. This rigidity is manifested by a small variation in the deflexion measured at the support face when a load of defined value is applied, compared to the ski when not subjected to any load.

It has been determined that by using the coefficient 2.78 is it possible to define the distance L separating the two support points such that the measured deflexion variation value has meaning, whatever the length of the ski.

According to one advantageous characteristic of the invention, the ratio of the variation in the deflexion to the bearing length is at most equal to 0.17%.

According to another advantageous characteristic of the invention, the flattening force of such skating skis, that is to say the force exerted at said mid-point of the bearing length of a ski laid flat on a plane surface, necessary to achieve residual deflexion of 0.3 mm, is at least equal to 400 newtons. It has thus been observed that, with a ski having such a characteristic, its rigidity is such that the results obtained both as regards its skiability and its thrust response are comparable with the expectations of experts in this technique.

Advantageously, the minimum thickness of the support face at its thickest point is 23 millimeters.

According to another characteristic of the invention, the ratio of the thickness of the support face at its thickest point to the bearing length is at least equal to 1.7%.

In order to optimize the characteristics of such a short skating ski, its dimension line, that is to say its developed and projected surface is broken down into five essential regions, namely from the heel to the tip:

(i) a first region, of short length, in which the width increases, thus defining a trapezoidal surface;

(ii) a second region, contiguous to the first region and extending substantially as far as the vicinity of the support face, having a constant width, thus defining a rectangular surface;

(iii) a third region extending from the support face to the widest point of the ski, namely the tip, in which the width also increases, defining a trapezoidal surface;

(iv) a fourth region extending from the widest point of the ski as far as the front contact line, in which region the width decreases, and thus constituting a substantially trapezoidal surface; and (v) a fifth region extending to the front end of the ski, having a width which decreases to a zero value, thereby defining the tip proper.

BRIEF DESCRIPTION OF THE DRAWINGS

The manner in which the invention may be embodied and the advantages which result therefrom will better emerge from the embodiment which follows, given by way of indication and without limitation, supported by the attached figures.

DETAILED DESCRIPTION OF THE INVENTION

Figures 1, 2, 3:
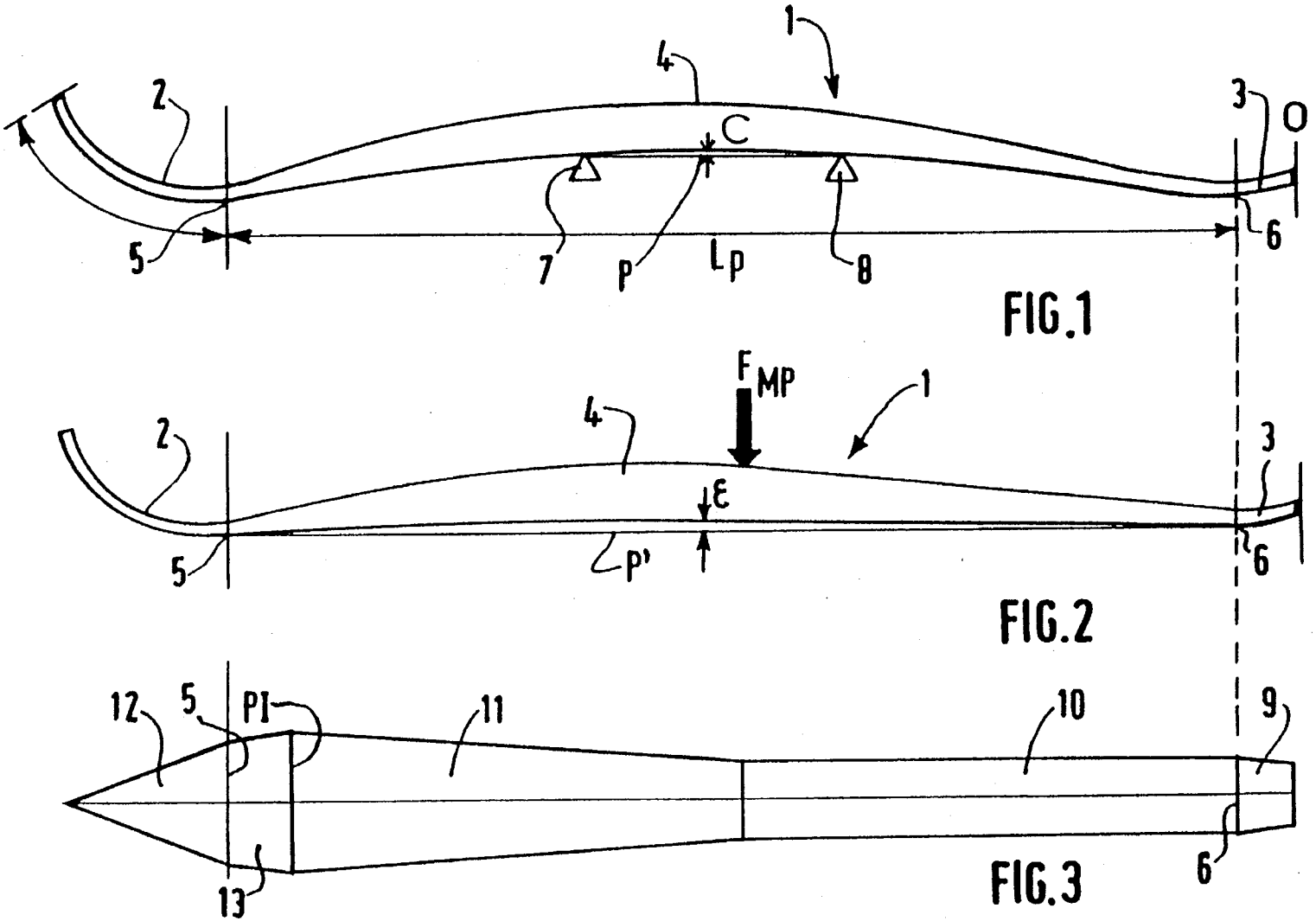
FIG. 1 is a cross-country ski according to the invention positioned on two supports, represented in a side view.
FIG. 2 is a similar view to FIG. 1, in which the flattening force has been represented.
FIG. 3 is a schematic representation of the projected developed surface of a ski according to the invention.

FIG. 1 schematically illustrates a cross-country ski (1) in side view, in place on two supports (7,8). In a conventional manner, this ski (1) includes a tip (2) extending in front of the front contact line (5) of the ski (1) and extending upward, and a heel (3) starting from the rear contact line (6), also extending slightly upward and thus constituting the raised heel. The central region of the ski, or support face (4), has a deflexion labelled by the letter C, with respect to the plane P passing through the two support points (7,8), so that, in the absence of any load, the support face (4) is not in contact with the ground. The bearing length $L_P$ is defined as extending between the two respective front (5) and rear (6) contact lines, that is to say that it is the length of the sole between these two lines. According to the invention, the bearing length of the ski is at most equal to 1,430 millimeters, substantially corresponding to a ski with a length equal to 1,650 millimeters.

According to the invention, this short ski is highly rigid at the support face. This rigidity is defined by the deformation of the ski when subjected to a load of 40 kilograms exerted at the mid-point of the distance L separating the two support points (7,8). This distance L is defined as being equal to the ratio of the bearing length $L_P$ to the coefficient 2.78. In addition, these two support points (7,8) are located at an equal distance L/2 on the middle of the bearing length $L_P$. Finally, this deformation is obtained by determining the value of the difference in deflexion C at this point with respect to the plane P passing through the two support points (7,8), in the absence of a load and with the 40 kg load respectively. The difference in the values obtained does not exceed two millimeters.

The smaller the deformation the more rigid the ski. This rigidity is suitable for the short skis thus obtained, making it possible to optimize the energy transfer between thrust given by the skier and the propulsion generated thereby. This ski is further more handleable, in view of the reduced bulk inherent with the actual skating technique, and also saves time during the flight phase, in view of the decreased wind resistance.

According to the present invention, the rigidity of the support face is tied to the bearing length $L_P$ by fixing the ratio of the difference in the deflexions, respectively in the absence of load and with a 40 kg load, to the bearing length $L_P$ at most equal to 0.17%.

Further in accordance with the present invention, the flattening force $F_{MP}$, that is to say the force which has to be applied at the mid-point of the bearing length $L_P$ in order to obtain a residual deflexion $\epsilon$ of 3/10 mm with respect to the plane P' passing through the two respective front (5) and rear (6) contact lines is, greater than or equal to 400 newtons.

The rigidity of the support face can be obtained by incorporating in the structure of the ski elements, or combinations of elements, in particular fibre or metal reinforcement, and also by increasing the thickness of the ski at the support face. Preferably, the thickness of the support face of the ski is linked to the bearing length $L_P$ by the relationship $$\frac{\text{thickness}}{L_P} \geqq 1.7\%$$

The minimum thickness of the thickest point of the support face is advantageously 23 millimeters.

According to the invention, the dimension line of the ski, represented in FIG. 3, satisfies a particular configuration which gives the ski handleability and effectiveness in its forward movement.

This projection of the ski is broken down into five main regions, namely:

(i) the region of the heel (9), the width of which increases from the rear end O of the ski to the vicinity of the rear contact line (6), thereby defining a substantially trapezoidal region;

(ii) the region (10), which extends from the region of the heel (9) and continues as far as the vicinity of approximately the mid-point of the bearing length $L_P$; this region has constant width and is therefore substantially rectangular;

(iii) the region (11) extending from the preceding region as far as the vicinity of the widest point of the ski, defined in the field by PI; the width of this region increases, thereby again defining a trapezoidal area;

(iv) the region (13) which extends the from preceding region and extends between the PI and the front contact line (5), and in which the width of the ski decreases, thereby defining a substantially trapezoidal surfaces; and (v) the region (12), which essentially corresponds to the tip, and in which the width decreases from the front contact line (5) to a zero value, corresponding to the front end of the ski. This region is substantially triangular.

All the characteristics listed above, given to a short ski whose support face develops such rigidity, and whose dimensioned line corresponds to the above description, thus make it possible to facilitate learning the skating technique. In this way, such skis allow adults in particular to learn a technique which had hitherto been restricted to the initiated and more particularly to sports persons. For the latter, these skis are particularly suited for optimizing performance, especially in view of the enhanced effectiveness of the energy transfer during thrusts, and their greater maneuverability.

We claim:

1. A cross-country ski, comprising:

a sole having a bearing length $L_P$ extending between a front and a rear contact line of said ski; and a support face extending away from said sole and having a deflexion of not more than 2 millimeters under a load of 40 kilograms, exerted at a mid-point of said bearing length $L_P$ compared with a deflexion in absence of said load, the deflexion being measured when said ski is placed on two supports separated by a length L, equal to a ratio $L_P/2.78$, said supports being centered with respect to the mid-point of said bearing length $L_P$ and the deflexion being defined with respect to a plane P passing through respective contact points between said supports and said sole.

2. A cross-country ski according to claim 1, wherein a ratio of the variation in the deflexion to the bearing length $L_P$ is at most equal to 0.17%.

3. A cross-country ski according to claim 1, wherein a flattening force $F_{MP}$, exerted at said mid-point of the bearing length $L_P$ of the ski resting on a plane surface P' incorporating the front and the rear contact lines, necessary to achieve deflexion of 0.3 mm, is at least equal to 400 newtons.

4. A cross-country ski according to claim 1, wherein a minimum thickness of the support face at its thickest point is 23 millimeters.

5. A cross-country ski according to claim 1, wherein a ratio of the thickness of the support face at its thickest point to the bearing length $L_P$ is at least equal to 1.7%.

6. A cross-country ski according to claim 1, further comprising:

a first region, of short length, extending from a rear end O of a heel of said ski, having a width which increases, as far as the vicinity of the rear contact line, thereby defining a trapezoidal surface;

a second region, contiguous to the first region and extending substantially as far as the vicinity of the support face, having a constant width thereby defining a rectangular surface;

a third region extending from the support face to a widest point PI of the ski, having a width which also increases, thereby defining a trapezoidal surface;

a fourth region extending between the widest point PI and the front contact line, having a width which decreases, thereby defining a substantially trapezoidal surface; and a fifth region extending from the front contact line to a front end of said ski, having a width which decreases to a zero value, thereby defining a tip.

* * * * *